US006734400B2

(12) United States Patent
Eller

(10) Patent No.: US 6,734,400 B2
(45) Date of Patent: May 11, 2004

(54) METHOD OF JOINING A ROD-SHAPED HEATING ELEMENT WITH A TUBULAR CARRIER ELEMENT, AND A GLOW PLUG INCLUDING A ROD-SHAPED HEATING ELEMENT IN A TUBULAR CARRIER ELEMENT

(75) Inventor: Martin Eller, Ludwigsburg (DE)

(73) Assignee: Beru AG, Ludwigshafen (DE)

( * ) Notice: Subject to any disclaimer, the term of this patent is extended or adjusted under 35 U.S.C. 154(b) by 15 days.

(21) Appl. No.: 10/207,384

(22) Filed: Jul. 30, 2002

(65) Prior Publication Data

US 2003/0034339 A1 Feb. 20, 2003

(30) Foreign Application Priority Data

Jul. 30, 2001 (DE) ..... 101 36 596

(51) Int. Cl.[7] ..... F23Q 7/22
(52) U.S. Cl. ..... 219/270; 29/611; 72/56
(58) Field of Search ..... 219/270, 672, 219/617; 123/145 A, 829; 29/402.13, 419.2, 610.1, 611, 613, 614; 72/56

(56) References Cited

U.S. PATENT DOCUMENTS 3,599,462 A * 8/1971 Kline et al. ..... 72/56
3,618,350 A * 11/1971 Larrimer, Jr. ..... 72/56
4,205,422 A * 6/1980 Hardwick ..... 29/402.13
4,207,451 A * 6/1980 Tudbury ..... 219/672
4,475,030 A * 10/1984 Bailey ..... 219/270
5,442,846 A * 8/1995 Snaper ..... 29/419.2
5,813,264 A * 9/1998 Steingroever ..... 72/56
6,054,680 A * 4/2000 Locher et al. ..... 219/270
6,229,125 B1 * 5/2001 Livshiz et al. ..... 219/617
6,255,626 B1 * 7/2001 Endler et al. ..... 219/270
6,335,516 B1 * 1/2002 Muller et al. ..... 219/270
6,474,534 B2 * 11/2002 Gabbianelli et al. ..... 228/131
6,477,774 B1 * 11/2002 Marando et al. ..... 29/897.2
6,605,801 B2 * 8/2003 Haussner et al. ..... 219/270
2001/0047989 A1 * 12/2001 Watqanabe et al. ..... 219/270

FOREIGN PATENT DOCUMENTS

DE 198 15 244 A1 10/1999
EP 0 843 130 A1 5/1998
JP 10141326 * 5/1998 ..... F16B/4/00

OTHER PUBLICATIONS

Magnetoplus®, Magnet–Physik DR. Steingroever GMBH, Köln, 1997, 1846/97, 4 Pages.

* cited by examiner

*Primary Examiner*—Ehud Gartenberg
*Assistant Examiner*—Leonid M Fastovsky
(74) *Attorney, Agent, or Firm*—Nixon Peabody LLP; David S. Safran

(57) ABSTRACT

Method of joining a rod-shaped heating element with a tubular carrier element involving attaching a cylindrical carrier ring to the rod-shaped heating element using a magnetic forming process and inserting the carrier ring and the rod-shaped heating element into the tubular carrier element such that the outer circumferential surface of the carrier ring contacts the inner circumferential surface of the tubular carrier element.

8 Claims, 2 Drawing Sheets

METHOD OF JOINING A ROD-SHAPED HEATING ELEMENT WITH A TUBULAR CARRIER ELEMENT, AND A GLOW PLUG INCLUDING A ROD-SHAPED HEATING ELEMENT IN A TUBULAR CARRIER ELEMENT

BACKGROUND OF THE INVENTION

1. Field of the Invention

The invention relates to a method for joining a rod-shaped heating element with a tubular carrier element, and a rod glow plug which includes a rod-shaped heating element in a tubular glow plug body.

2. Description of Related Art

Rod-shaped heating elements which are supported in tubular carrier elements are known. One of the best known examples of a rod-shaped heating element is a glow plug which includes a rod-shaped glow pencil is supported in a tubular glow plug body.

When joining a glow pencil and a glow plug body, the glow pencil is pressed or inserted into the glow plug body. In such a case, only materials which exhibit sufficient deformability and non-deformability for such a pressing-in operation can be used. For pressing-in the heating element, certain component lengths, especially of the glow pencil, should not be exceeded in order to avoid buckling of this component during the pressing-in operation. Furthermore, grooves can arise during pressing-in, which lead to looseness between the glow pencil and the glow plug body.

SUMMARY OF THE INVENTION

The object of the present invention is to provide a method of joining a rod-shaped heating element with a tubular carrier element so as to overcome the aforementioned disadvantageous effects that occur with the pressing-in of the heating element into the carrier element. At the same time, the method in accordance with the present invention does not require a certain component length in order to avoid the buckling of the component. In this regard, a ceramic rod-shaped heating element may be used in order to be easily joined with metal carrier elements without the aforementioned groove formation occurring.

The aforementioned problems are solved in accordance with the present invention by providing a method of joining a rod-shaped heating element with a tubular carrier element whereby a cylindrical carrier ring is connected to the rod-shaped heating element using magnetic forming technology, and the rod-shaped heating element and carrier element are subsequently inserted into the tubular carrier element.

An advantageous feature in accordance with the present invention is the attaching or forming of the rod-shaped heating element with a carrier ring using magnetic forming technology. The magnetic forming technology may be providing using "MagnetoPuls" from Magnet-Physik Dr. Steingroever GmbH of Cologne, Germany.

The present invention will be explained in greater detail with a preferred example of a glow plug with rod-shaped heating element and tubular carrier element according to the following figures, which show:

DETAILED DESCRIPTION OF THE INVENTION

Figure 1:
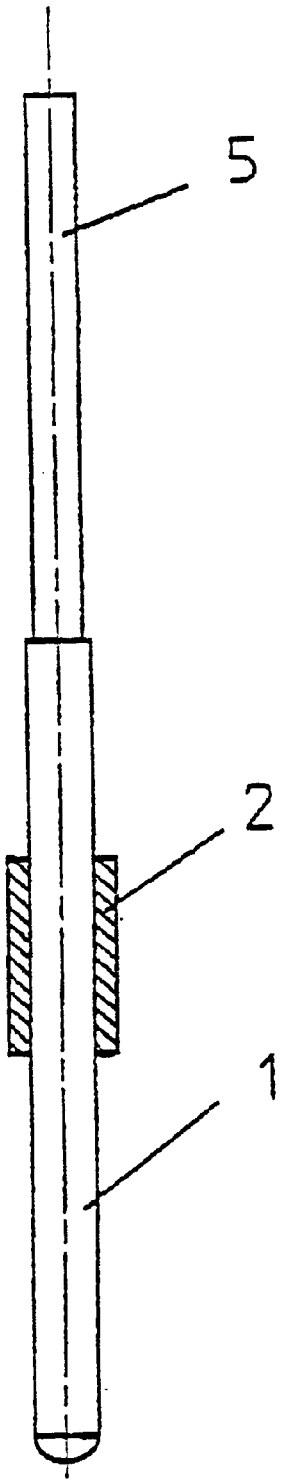
FIG. 1 shows a diagrammatic side view of a glow pencil with a cylindrical carrier ring and a connection pole.

FIG. 1 shows a diagrammatic side view of a glow pencil 1 made of an electrically conductive ceramic, on which a carrier ring 2 is formed or attached using magnetic forming technology. The material of carrier ring 2 is electrically conductive and deformable using magnetic forming technology. A connection pole 5 used as a positive pole is connected to the glow pencil 1.

Figure 2:
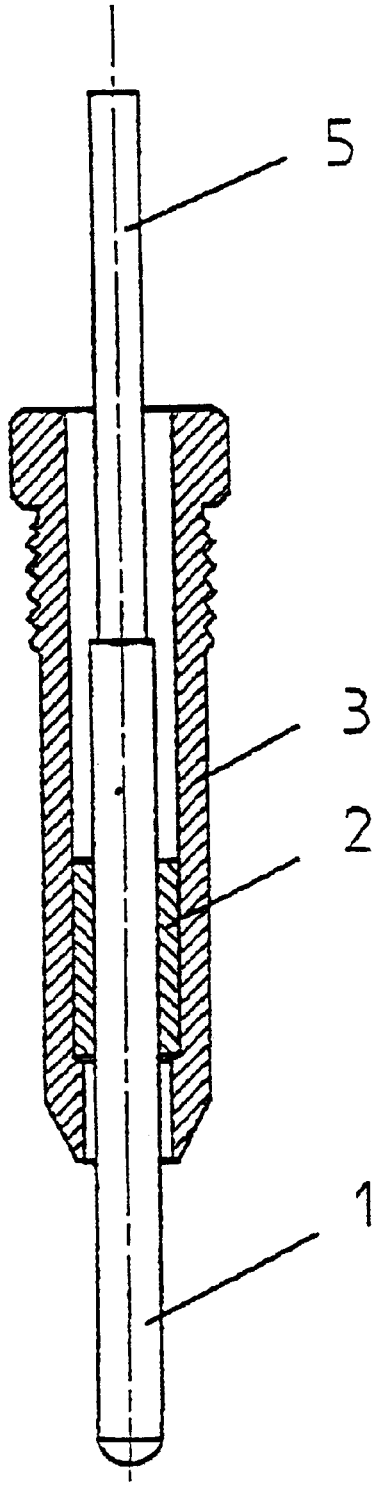
FIG. 2 shows a glow pencil provided with a carrier ring and a connection pole, each of which is fitted into a glow plug casing.

As shown in FIG. 2, a single-pole glow plug as shown FIG. 1 is inserted into the glow plug body 3, the glow plug body serving as an earth or negative pole. The insertion of the glow pencil and the carrier ring 2 is such that the pressing-in or inserting force is brought to bear on the carrier ring 2, so that the risk of buckling the glow pencil 1 and the connection pole 5 is prevented. Such a design permits the use of very thin glow pencils 1 and glow pencils that are composed of a brittle material, such as ceramics. Preferably, the glow plug body 3 is attached to the carrier ring 2 using magnetic forming technology, as will be described in detail somewhat later in the description of FIGS. 4 and 5.

Alternatively, instead of composing the glow pencil 1 of a ceramic material, the glow pencil 3 may be composed of an electrically conductive metal. The method in accordance with the present invention is advantageous since the electrically conductive metal glow pencil 1 does not have to have the thickness and stability of conventional glow pencils, and thus, permits the production and joining, connecting or attaching of very thin-walled glow pencils 1 and glow-pencil casings or bodies 3.

Figure 3:
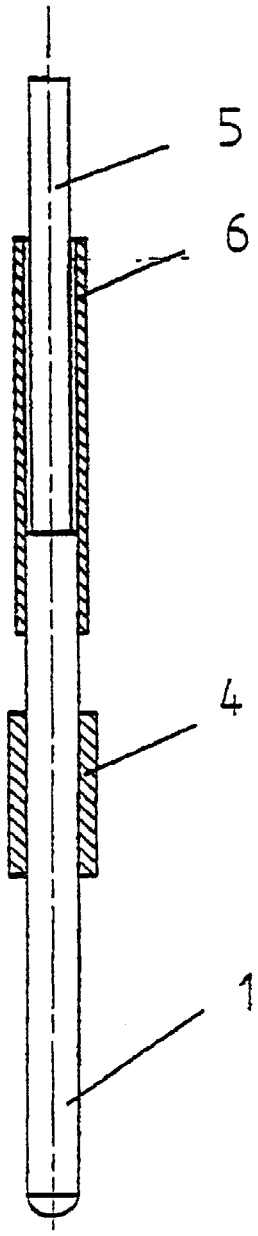
FIG. 3 shows a glow pencil with a cylindrical carrier ring, a contact sleeve and a connection pole.

FIG. 3 shows, in a second embodiment of the invention, a glow plug including a glow pencil 1, a carrier ring 4 and a connection pole 5. The glow pencil 1, preferably composed of a ceramic, is connected to an internal pole 5 which axially projects on a connection side. Also provided on the connection side so as to axially surround the glow pencil 1 and the connection pole 5 is a contact sleeve 6 that is connected thereto using magnetic forming technology. The carrier ring 4 is preferably composed of a material that is deformable when using magnetic forming technology. However, the surface of the carrier ring 4, at least the outer circumferential surface, may be made to become electrically insulating by coating it with an electrically insulating ceramic layer. Furthermore, the carrier ring 4 is attached or connected to the glow pencil 1 using magnetic forming technology. Alternatively, the glow pencil 1 can also be composed of steel, whereby it is then electrically insulated by depositing a ceramic layer thereon.

If the contact sleeve 6 has an identical external diameter to the carrier ring 4, outer circumferential surface is designed so as to be insulated by providing an electrically insulating ceramic coating. Preferably, however, the external diameter of the carrier ring 4 is greater than the external diameter of the contact sleeve 6 so that the glow plug body 3 does not physically contact the contact sleeve 6. The carrier ring 4 is preferably composed of copper or an aluminum alloy, and may be insulated with an anodized layer or a lacquer layer.

Figure 4:
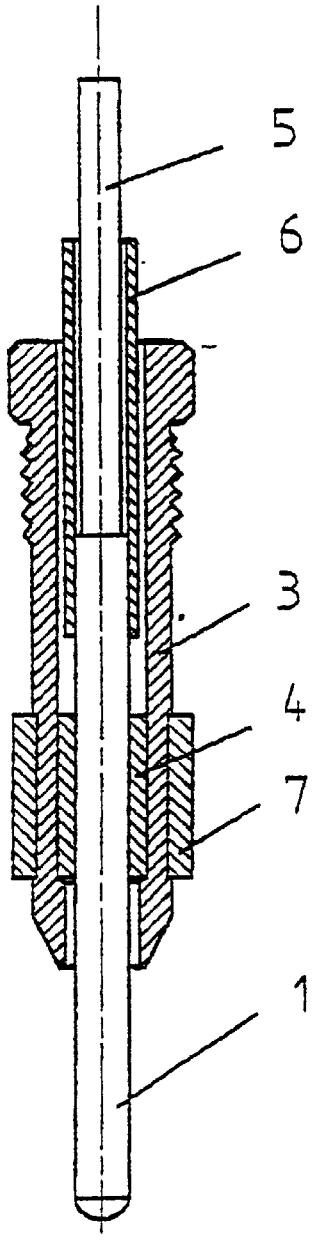
FIG. 4 shows the glow pencil shown in FIG. 3 with a carrier ring, a contact sleeve and a connection pole in a glow plug body with a transfer ring lying adjacent on the outside.

As shown in FIG. 4, the glow plug in accordance with FIG. 3 is inserted into the glow plug body 3 using magnetic forming technology. Surrounding the glow plug body 3 and the carrier ring 4 is a transfer ring 7, through which the magnetic forming of the components occurs.

Figure 5:
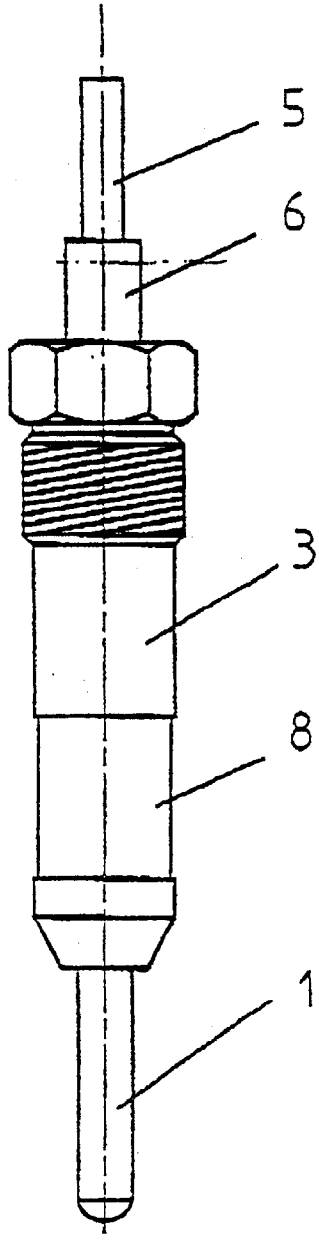
FIG. 5 shows another embodiment of a glow plug in accordance with FIGS. 3 and 4 with the transfer ring removed and a sealing and fixing cylindrical necked-down portion of a glow plug body.

As shown in FIG. 5, the glow plug body 3, after removal of transfer ring 7, has a cylindrical necked-down portion 8 which is formed over the internal carrier ring 4, thereby firmly joining the arrangement shown in FIG. 3 in the glow plug body 3. The contact sleeve 6, which projects from the glow plug body 3, is designed as a negative-contact connection while the glow plug casing 3 is potential-free. Preferably, the contact sleeve 6, the carrier rings 2, 4 and the transfer ring 7 are respectively composed of copper, aluminum or light-metal alloys.

What is claimed is:

1. A method of producing a glow plug having a rod-shaped heating element, said rod-shaped heating element being composed of an electrically conductive ceramic material; a carrier ring attached to said rod-shaped heating element, said carrier ring being composed of an electrically conductive material and magnetically-deformable material; and a tubular carrier element attached to said carrier ring so as to surround said rod-shaped heating element and said carrier ring, comprising the steps of:

attaching the cylindrical carrier ring to the rod-shaped heating element using a magnetic forming process; and inserting the carrier ring and the rod-shaped heating element into the tubular carrier element such that the outer circumferential surface of the carrier ring contacts the inner circumferential surface of the tubular carrier element.

2. The method according to claim 1, wherein the tubular carrier element is composed of an electrically conductive material.

3. The method according to claim 2, wherein said attachment step comprises surrounding the tubular carrier element and the carrier ring with a transfer ring, attaching the carrier ring to the tubular cattier element, and removing the transfer ring after attaching the carrier ring to the tubular carrier element.

4. The method according to claim 1, wherein said attachment step comprises surrounding the tubular carrier element and the carrier ring with a transfer ring, attaching the carrier ring to the tubular carrier element, and removing the transfer ring after attaching the carrier ring to the tubular carrier element.

5. The method according to claim 1, wherein the outer circumferential surface of the carrier ring is provided with an electrically insulating coating and the rod-shaped heating element is composed of an electrically conductive ceramic.

6. The method according to claim 5, further comprising the step of attaching a contact sleeve on a connection side of the rod-shaped heating element using a magnetic forming process, said contact sleeve being composed of an electrically conductive material.

7. The method according to claim 6, wherein the diameter of the carrier ring is greater than that of the contact sleeve.

8. The method according to claim 7, wherein said attachment step comprises surrounding the tubular carrier element and the carrier ring with a transfer ring, attaching the carrier ring to the tubular carrier element, and removing the transfer ring after attaching the carrier ring to the tubular carrier element.

* * * * *